United States Patent [19]

Hannen

[11] Patent Number: 4,548,578

[45] Date of Patent: Oct. 22, 1985

[54] BURNER FOR GENERATION OF A FLOW OF HOT GAS, ESPECIALLY FOR SHRINKING PLASTIC FOILS

[75] Inventor: Reiner W. Hannen, Goch, Fed. Rep. of Germany

[73] Assignee: MSK-Verpackungs-Systeme Gesellschaft mit beschrankter Haftung, Kleve, Fed. Rep. of Germany

[21] Appl. No.: 597,446

[22] Filed: Apr. 6, 1984

[30] Foreign Application Priority Data

Apr. 8, 1983 [DE] Fed. Rep. of Germany ... 8310308[U]

[51] Int. Cl.[4] ..... F23D 13/24

[52] U.S. Cl. ..... 431/350; 431/353

[58] Field of Search ..... 431/328, 350, 353, 171; 432/222

[56] References Cited

U.S. PATENT DOCUMENTS 4,462,795 7/1984 Vosper et al. ..... 431/350 X

FOREIGN PATENT DOCUMENTS 46-14626 4/1971 Japan ..... 431/350

*Primary Examiner*—Margaret A. Focarino

*Attorney, Agent, or Firm*—Karl F. Ross; Herbert Dubno

[57] ABSTRACT

A burner for generating hot gases to be used for packaging purposes with thermal shrinkage of plastic foils has an elongate rectangular zone of transition between its pressure-distribution and combustion chambers, spanned by a flame-retaining tube forming narrow passages for the gas flow with the adjacent walls. A number of codirectionally curved sheet-metal baffles equispaced, and of equal radius of curvature, mounted on the downstream side of the tube and extending toward the opposite walls of the chamber, improve the combustion conditions of the gas mixture and lead to a higher velocity of the stream of hot gases leaving the burner, thus increasing the amount of ambient air entrained into the stream and thereby reducing the temperature of the combustion gases.

17 Claims, 2 Drawing Figures

BURNER FOR GENERATION OF A FLOW OF HOT GAS, ESPECIALLY FOR SHRINKING PLASTIC FOILS

FIELD OF THE INVENTION

My present invention relates to a burner for generating a flow of hot gas, mainly used for shrinking of a plastic foil hood to enshroud a stack of goods supported on a pallet.

BACKGROUND OF THE INVENTION

The shrinking of a plastic foil can be accomplished with hand-held apparatus or by means of stationary automatically operating installations, e.g. as described in my copending application Ser. No. 566,330 filed Dec. 28, 1983. For good results of this operation, it is important to produce a uniform, flame-free stream of hot gas which can be obtained by providing the widest possible outflow area for the gases leaving the burner. For this purpose the combustion chamber of the burner and its discharge end should have an elongate shape. A flame retainer provides a uniform pressure distribution of the gases entering the combustion chamber and to improve the mixing of the combustible gases with the oxygen-containing gases.

A burner of the defined kind, e.g. is described in German utility model No. 82 20 335, has a flame holder in the shape of a transverse tube extending completely across the burner. The tube splits the gas flow entering the chamber into partial flows passing through the passages between the tube and the adjacent walls into the combustion chamber which are drawn toward its center by the dead-air space downstream of the tube, thereby lessening the strain on the combustion-chamber walls. The gases exit from the burner at a state of high turbulence, which leads to a reduction of the jet velocity of the hot gases at the burner exit and to a lower noise level.

For use with a foil-shrinking apparatus, however, it is desirable to have the gases leave the burner at high speed in order to let the stream entrain more cold ambient air which mixes with the hot gases and lowers their temperature, thus avoiding burns of the plastic foils to be shrunk.

OBJECT OF THE INVENTION

The object of my invention is therefore to improve the kind of burner described above so as to obtain a higher exit velocity of the hot gases without thereby increasing the level of noise generation.

SUMMARY OF THE INVENTION

According to my invention, a row of curved baffles are mounted on the downstream side of the transverse tube, with their free ends facing the burner outlet, and performing the following functions:

- assist the tubular flame retainer in accomplishing a better mixing of the gases entering the combustion chamber;
- stabilize accordingly the flame downstream of the flame retainer;
- adjust the direction of flow of hot gases toward the exit of the combustion chamber, while inside this chamber, thus considerably increasing the exit velocity. Consequently, the stream of hot gases outside the burner will entrain more cold ambient air to mix with the hot gases and will reduce their temperature.

By extending the guides and joining them with the opposite walls of the combustion chamber, the entire stream of hot gases is picked up by the guides and routed in the right direction. The curvature and the directional mounting could be the same for all guides. I have obtained especially good results by using guides having the radius of curvature nearly equal to the diameter of the tube. Also, for the same reasons, the spaces between the guides should be close to 1.5 tube diameters. The free ends of the guides should be close to 3/5 of their total length and it is favorable to have them extending by ¼ of the tube diameter over the tube half in upstream direction.

Thus a burner for generating a flat hot gas stream for the thermal shrinkage of a synthetic resin foil can comprise, according to the invention a fan-shaped pressure distribution chamber defined between a pair of fan-shaped walls and having a narrow end and a wide end, the walls extending beyond said wide end to define a burner chamber extending over the entire length of the wide end and having an elongated cross section opening at a mouth of said burner chamber, inlet means for introducing a gas to the pressure distribution chamber, a flame-retaining tube disposed between these walls substantially at the junction between said chambers and defining with the walls narrow passages for gas flow between said tube and the walls from said distribution chamber into the burner chamber, and a row of spaced apart curved baffles straddling the tube and mounted on the tube downstream of the pressure distribution chamber while having free ends reaching toward the mouth.

Advantageously the baffles bridge the walls and are connected thereto, and of the baffles are oriented similarly and have similar radii of curvature. Preferably all of the baffles are identical to one another, and are disposed with substantially identical orientations with respect to the walls and the tube. Furthermore, the radii of curvature of the baffles can correspond substantially to the diameter of said tube, the baffles can be spaced apart from one another by substantially 1.5 times the diameter of the tube, the baffles can have free ends disposed at a distance from said tube which is equal to substantially 3/5 of the length of the baffle, the baffles can straddle the tube over a height therealong which is substantially ¼ of the diameter of said tube, and the free ends of said baffles terminate at a distance from said mouth of substantially 0.7 to 0.1 times the length of said mouth.

Specifically the free ends of said baffles project beyond the tube by a distance of substantially 0.05 to 0.07 times the length of said mouth, the baffles have lengths between substantially 0.06 and 0.08 times the length of the mouth, the tube has an axis disposed at a distance between substantially 0.1 and 0.2 times the length of said mouth, the baffles are composed of sheet metal and have thicknesses of substantially 0.1 mm, the baffles have shanks straddling the tube and of lengths between 2 and 5 times the thickness of the baffle, and the baffles have spacings of substantially 0.08 to 0.11 times the length of said mouth.

When the pressure distribution chamber is provided with a V-shaped insert converging toward said inlet means, the insert includes an angle of substantially 100° to 135° and preferably about 117°.

BRIEF DESCRIPTION OF THE DRAWINGS

The above object and features of my invention become more readily apparent from the embodiment as defined in the accompanying drawing in which.

SPECIFIC DESCRIPTION

Figure 1:
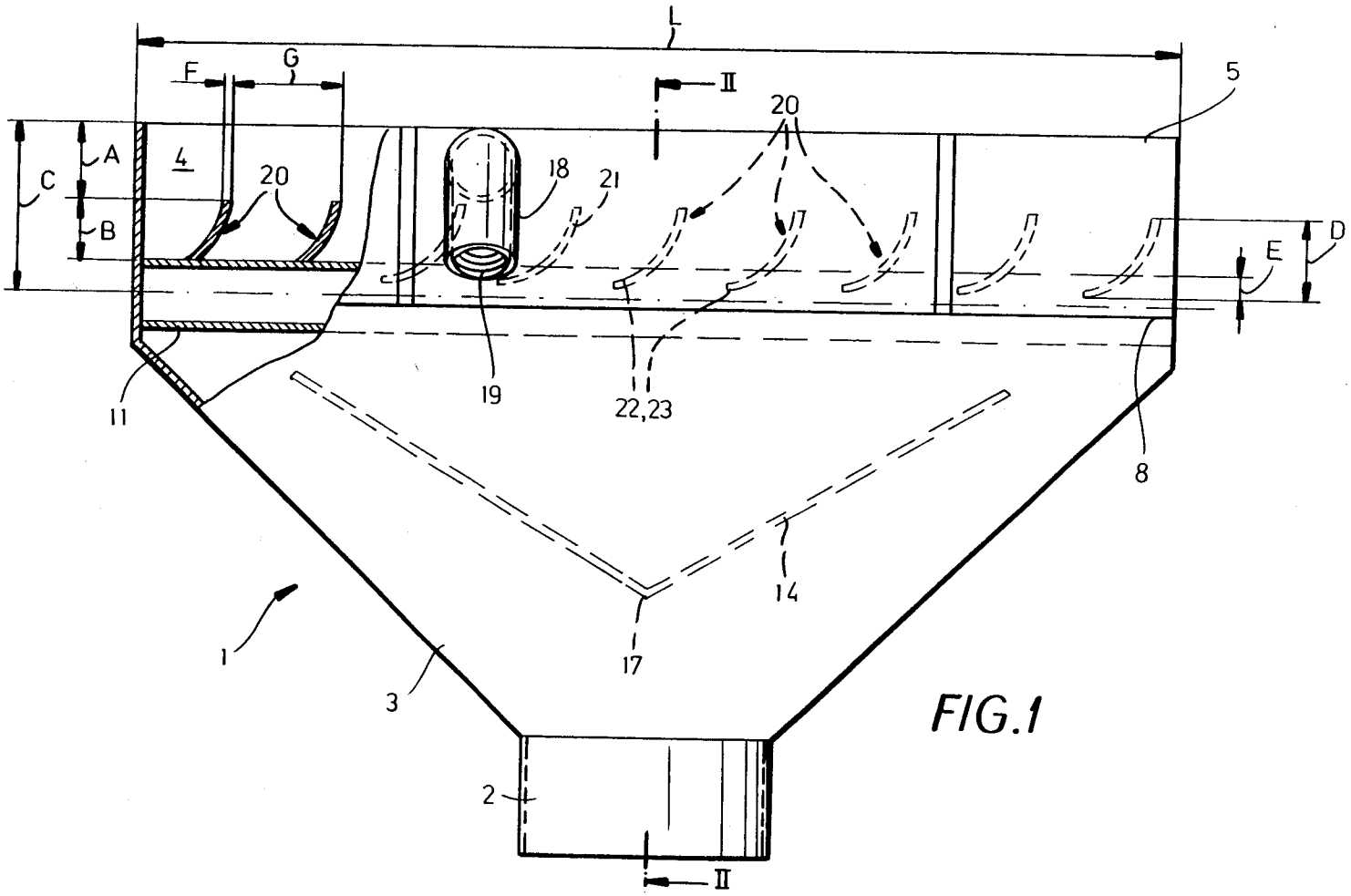
FIG. 1 is a plan view of a burner embodying the invention.

The burner 1 comprises basically a mixture supply conduit 2 with a pressure distribution chamber 3, having a fan-shaped cross section (FIG. 1) connected to it and ending with a combustion chamber 4, with outlet 5.

Figure 2:
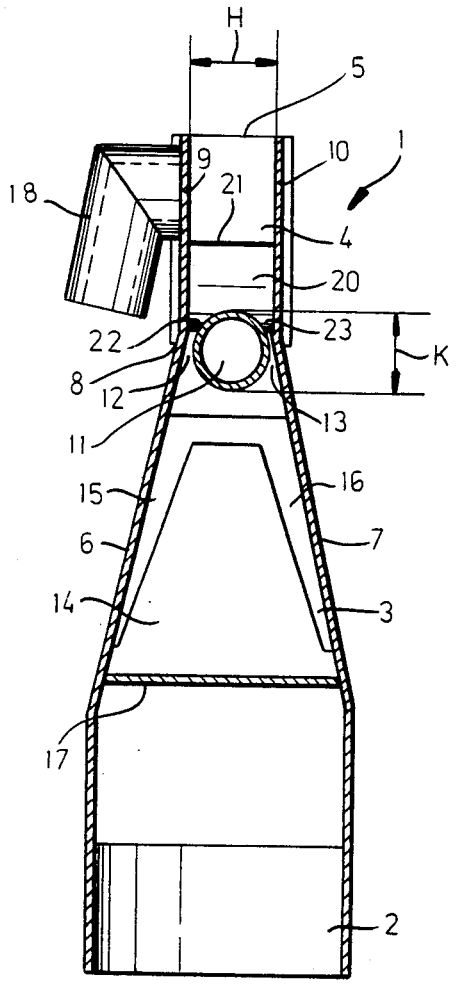
FIG. 2 is a section taken on the line II—II of FIG. 1.

The zone of transition between pressure distribution chamber 3 and combustion chamber 4 has an elongated rectangular shaped cross section, the lateral walls 6, 7 of pressure distribution chamber 3 converging toward this section (FIG. 2).

After a bend 8, the side walls 6, 7 of pressure distribution chamber 3 change over into walls 9, 10 of combustion chamber 4 (FIG. 2).

Combustion chamber 4 is designed with length C (FIG. 1) surpassing its height H (FIG. 2). In the zone of transition, the width L of the combustion chamber is the same for the pressure distribution chamber and can be about 185 mm.

In the zone of transition between pressure distribution chamber 3 and combustion chamber 4 a tube 11 spans the entire width of the zone and serves as a flame holder. Tube 11 is installed symmetrically to bend 8 and forms with the adjacent walls 6, 7, resp. 9, 10, equidistant passages 12, 13 for the gas mixture, which is thus uniformly distributed along the tube.

On the downstream side of tube 11 and attached to it are a number of curved sheet metal guides 20, having their free ends directed toward the burner outlet 5. The guides 20 extend between the opposite walls 9, 10 of the combustion chamber 4 and join the walls. All guides have the same radius of curvature and directional orientation. The radius of curvature is equal to the tube diameter K (FIG. 2) and the interval G between the guides is close to 1.5 tube diameters (FIG. 1). The free ends 21 of guides 20 equal to approx. 3/5 of their total length and their fixed ends 22, 23 surpass the tube diameter by ¼ tube diameters in upstream direction (FIG. 1).

The pressure distribution chamber 3 is provided with inserts to improve the distribution of the pressure of the gases entering combustion chamber 4. In the defined embodiment, the insert is a piece of sheet metal 14 extending across pressure distribution chamber 3 and forming passages 15, 16 with its lateral walls 6, 7. The sheet is bent in the middle, thus forming two wings, attached at their common bending edge 17 to sidewalls 6, 7. The two wings, having an internal angle of approx. 117° do extend in the direction of the combustion chamber 4 and contribute to the equalizing of the flow and pressure of the gases coming through supply duct 2 and entering the combustion chamber 4. For the same purpose sheet 14 could have perforations.

For the defined embodiment I selected the size and dimensions as shown below:

A = 16 mm
B = 10 mm
C = 32 mm
D = 13 mm
E = 3 mm
F = 1 mm
G = 17 mm
H = 18 mm
K = 12 mm
L = 185 mm

On one of the combustion chamber walls 9 or 10 a nipple 18 with threaded end 9 could be installed when required for construction purposes, e.g. to hold the burner, and to hold a spark plug or other igniter for the flammable mixture which is accelerated to the mouth by the vanes or baffles 21.

I claim:

1. A burner for generating a flat hot gas stream for the thermal shrinkage of a synthetic resin foil comprising:

a fan-shaped pressure distribution chamber defined between a pair of fan-shaped walls and having a narrow end and a wide end, said walls extending beyond said wide end to define a burner chamber extending over the entire length of said wide end and having an elongated cross section opening at a mouth of said burner chamber;

inlet means for introducing a gas to said pressure distribution chamber;

a flame-retaining tube disposed between said walls substantially at the junction between said chambers and defining with said walls narrow passages for gas flow between said tube and said walls from said distribution chamber into said burner chamber; and a row of spaced apart curved baffles straddling said tube and mounted on said tube downstream of said pressure distribution chamber while having free ends reaching toward said mouth, said baffles bridging said walls and being connected thereto.

2. The burner defined in claim 1 wherein all of said baffles are oriented similarly and have similar radii of curvature.

3. The burner defined in claim 2 wherein all of said baffles are identical to one another, and are disposed with substantially identical orientations with respect to said walls and said tube.

4. The burner defined in claim 1 wherein said free ends of said baffles terminate at a distance from said mouth of substantially 0.07 to 0.1 times the length of said mouth.

5. The burner defined in claim 1 wherein said free ends of said baffles project beyond said tube by a distance of substantially 0.05 to 0.07 times the length of said mouth.

6. The burner defined in claim 1 wherein said baffles have lengths between substantially 0.06 and 0.08 times the length of said mouth.

7. The burner defined in claim 1 wherein said tube has an axis disposed at a distance between substantially 0.1 and 0.2 times the length of said mouth.

8. The burner defined in claim 1 wherein said baffles are composed of sheet metal and have thicknesses of substantially 0.1 mm.

9. The burner defined in claim 8 wherein said baffles have spacings of substantially 0.08 to 0.11 times the length of said mouth.

10. A burner for generating a flat hot gas stream for the thermal shrinkage of a synthetic resin foil comprising:

a fan-shaped pressure distribution chamber defined between a pair of fan-shaped walls and having a narrow end and a wide end, said walls extending beyond said wide end to define a burner chamber extending over the entire length of said wide end and having an elongated cross section opening at a mouth of said burner chamber;

inlet means for introducing a gas to said pressure distribution chamber;

a flame-retaining tube disposed between said walls substantially at the junction between said chambers and defining with said walls narrow passages for gas flow between said tube and said walls from said distribution chamber into said burner chamber; and a row of spaced apart curved baffles straddling said tube and mounted on said tube downstream of said pressure distribution chamber while having free ends reaching toward said mouth, all of said baffles being identical, having similar radii of curvature, and being disposed with substantially identical orientations with respect to said walls and said tube, the radii of curvature of said baffles corresponding substantially to the diameter of said tube.

11. The burner defined in claim 10 wherein said baffles are spaced apart from one another by substantially 1.5 times the diameter of said tube.

12. The burner defined in claim 10 wherein said baffles have free ends disposed at a distance from said tube which is equal to substantially 3/5 of the length of the baffle.

13. A burner for generating a flat hot gas stream for the thermal shrinkage of a synthetic resin foil comprising:

a fan-shaped pressure distribution chamber defined between a pair of fan-shaped walls and having a narrow end and a wide end, said walls extending beyond said wide end to define a burner chamber extending over the entire length of said wide end and having an elongated cross section opening at a mouth of said burner chamber;

inlet means for introducing a gas to said pressure distribution chamber;

a flame-retaining tube disposed between said walls substantially at the junction between said chambers and defining with said walls narrow passages for gas flow between said tube and said walls from said distribution chamber into said burner chamber; and a row of spaced apart curved baffles straddling said tube and mounted on said tube downstream of said pressure distribution chamber while having free ends reaching toward said mouth, all of said baffles being identical having similar radii of curvature, and being disposed with substantially identical orientations with respect to said walls and said tube, said baffles straddle said tube over a height therealong which is substantially one-quarter of the diameter of said tube.

14. A burner for generating a flat hot gas stream for the thermal shrinkage of a synthetic resin foil comprising:

a fan-shaped pressure distribution chamber defined between a pair of fan-shaped walls and having a narrow end and a wide end, said walls extending beyond said wide end to define a burner chamber extending over the entire length of said wide end and having an elongated cross section opening at a mouth of said burner chamber;

inlet means for introducing a gas to said pressure distribution chamber;

a flame-retaining tube disposed between said walls substantially at the junction between said chambers and defining with said walls narrow passages for gas flow between said tube and said walls from said distribution chamber into said burner chamber; and a row of spaced apart curved baffles straddling said tube and mounted on said tube downstream of said pressure distribution chamber while having free ends reaching toward said mouth, all of said baffles being identical, having similar radii of curvature, and being disposed with substantially identical orientations with respect to said walls and said tube, said tube having an axis disposed at a distance between substantially 0.1 and 0.2 times the length of said mouth, said baffles having shanks straddling said tube and of lengths between 2 and 5 times the thickness of the baffle.

15. A burner for generating a flat hot gas stream for the thermal shrinkage of a synthetic resin foil comprising:

a fan-shaped pressure distribution chamber defined between a pair of fan-shaped walls and having a narrow end and a wide end, said walls extending beyond said wide end to define a burner chamber extending over the entire length of said wide end and having an elongated cross section opening at a mouth of said burner chamber;

inlet means for introducing a gas to said pressure distribution chamber;

a flame-retaining tube disposed between said walls substantially at the junction between said chambers and defining with said walls narrow passages for gas flow between said tube and said walls from said distribution chamber into said burner chamber; and a row of spaced apart curved baffles straddling said tube and mounted on said tube downstream of said pressure distribution chamber while having free ends reaching toward said mouth, all of said baffles being identical having similar radii of curvature, and being disposed with substantially identical orientations with respect to said walls and said tube, said baffles being composed of sheet metal and have thicknesses of substantially 0.1 mm, and having spacings of substantially 0.08 to 0.11 times the length of said mouth, said pressure distribution chamber being provided with a V-shaped insert converging toward said inlet means.

16. The burner defined in claim 15 wherein said insert includes an angle of substantially 100° to 135°.

17. The burner defined in claim 16 wherein said angle is substantially 117°.

* * * * *